US006086160A

United States Patent [19]

Bitelli

[11] Patent Number: 6,086,160

[45] Date of Patent: Jul. 11, 2000

[54] TOOLHOLDER FOR MILLING DRUMS OF SCARIFYING MACHINES

[75] Inventor: Romolo Bitelli, S. Lazzaro, Italy

[73] Assignee: Bitelli SpA, Minerbio, Italy

[21] Appl. No.: 09/291,480

[22] Filed: Apr. 14, 1999

[30] Foreign Application Priority Data

Nov. 9, 1908 [IT] Italy ..... VI98U0097

[51] Int. Cl.[7] ..... E21C 35/18

[52] U.S. Cl. ..... 299/104; 299/102; 299/106

[58] Field of Search ..... 299/102, 104, 299/106

[56] References Cited

U.S. PATENT DOCUMENTS

| | | | |
|---|---|---|---|
| Re. 29,900 | 2/1979 | Kniff | 299/104 |
| 3,841,708 | 10/1974 | Kniff et al. | 299/104 |
| 4,159,746 | 7/1979 | Wrulich et al. | 175/354 |
| 4,688,856 | 8/1987 | Elfgen | 299/104 |
| 5,725,283 | 3/1998 | O'Neill | 299/104 |
| 5,730,502 | 3/1998 | Montgomery, Jr. | 299/104 |
| 5,842,747 | 12/1998 | Winchester | 299/87.1 |

*Primary Examiner*—Eileen Dunn Lillis
*Assistant Examiner*—Sunil Sigh
*Attorney, Agent, or Firm*—Watson Cole Grindle Watson, P.L.L.C.

[57] ABSTRACT

A toolholder for milling drums of scarifying machines including a body having a longitudinal axis, at one end provided with a housing suitable to house a milling tool. The body of the toolholder has an outside annular groove so as to reduce the resisting section of the toolholder and form a pre-set breaking area.

17 Claims, 3 Drawing Sheets

TOOLHOLDER FOR MILLING DRUMS OF SCARIFYING MACHINES

BACKGROUND OF THE INVENTION

FIELD OF THE INVENTION

The invention relates to a toolholder suitable to be applied to milling drums of scarifying machines.

DESCRIPTION OF THE RELATED ART

It is known that scarifying machines are used for the removal of the bituminous carpet covering roads.

Such machines are provided with a milling drum having a plurality of projecting active elements that, during the rotation of the milling drum to which they are applied, crumble the surface to be removed with which they come into contact. Each active element of a milling tool is inserted through an aperture in a toolholder in which it is free to rotate around its own axis, but from which it can not be separated through the stopping action of an interposed elastic element. The toolholder has a steel body extending longitudinally, in which there is a housing for receiving the milling tool. The toolholder is removably inserted in a hole formed in a prismatic base, which is removably fixed in a base block welded to the drum.

Toolholders of the mentioned type are those which are described also in the patent applications registered in the name of the same applicant of the present patent. In these devices, each of the active elements applied to the milling drum is provided with a toolholder having a cylindrical central area. On one side of the cylindrical central area is a first truncated-cone shaped surface coupled in the respective hole of the prismatic base. On the opposite side of the cylindrical central area is a second truncated-cone shaped surface with an inclination converging toward the tool.

These toolholders have some drawbacks. A first drawback is that, because of the particular shape according to which the toolholder is built, it is not the weakest of the active element to which it belongs. This implies that, if during the manufacturing the active element is exposed to a greater stress than the greatest allowed stress, it will break preferably in correspondence with the areas in which the prismatic base is connected to the base block or in correspondence with the weldings fixing the base block to the drum.

It can be understood that such second possibility can damage the milling drum as a whole, creating expensive maintenance costs.

A further drawback is that the coupling between the first truncated-cone shaped surface and the respective hole made in the removable bar housing it, is not sufficiently protected against the accidental intrusion of dirt and foreign bodies.

The present invention intends to overcome such drawbacks.

BRIEF SUMMARY OF THE INVENTION

An objective of the invention is that the toolholder is the most structural yielding part among all the parts forming the active element of the milling drum of a scarifying machine.

Another objective is that the toolholder of the invention has, with respect to toolholders of the known type, a better resistance to abrasion.

The objectives are achieved through the realization of a toolholder for milling drums of scarifying machines, that has a body defining a longitudinal axis with a housing suitable to house a milling tool at one end and having a truncated-cone shaped piece of the external surface with an inclination converging toward the end opposite to the end housing of the tool; the lateral external surface having the shape of a truncated cone for removably housing in a respective truncatedcone shaped hole in a support unit belonging to the external lateral surface of the milling drum wherein the body of the toolholder has an external annular groove projecting from the support unit and reducing the resisting section of the toolholder in order to define a pre-set breaking area.

According to a preferred embodiment, the groove is between an annular collar and an annular projection, spaced apart and both projecting radially from the toolholder body 1 with the annular collar placed adjacent the hole housing the toolholder.

The toolholder end housing the milling tool has the shape of a concave truncated-cone. The surface of the toolholder end has a concave truncated-cone shape and has in a longitudinal section, a curved outline. The annular groove causes the toolholder to break along the section where it is made, preventing the removable base from breaking and of the base block welded to the drum from breaking.

Another advantage of the annular collar defining the groove is that it works as a protection against the intrusion of foreign bodies in the coupling between the truncated-cone shaped part and the respective housing.

The aims will be better understood during the description of a preferred embodiment of the invention referring to the enclosed drawings in which:

DETAILED DESCRIPTION OF THE INVENTION

As it can be observed in the FIGS. 1, 2, 3, 6 and 7, the toolholder of the invention, marked with 1 as a whole, is of the type which can be applied to a support unit marked with G as a whole. The support unit G is fixed to the external lateral surface S of the milling drum T of a scarifying machine, not shown.

Figures 1, 2, 3, 4:
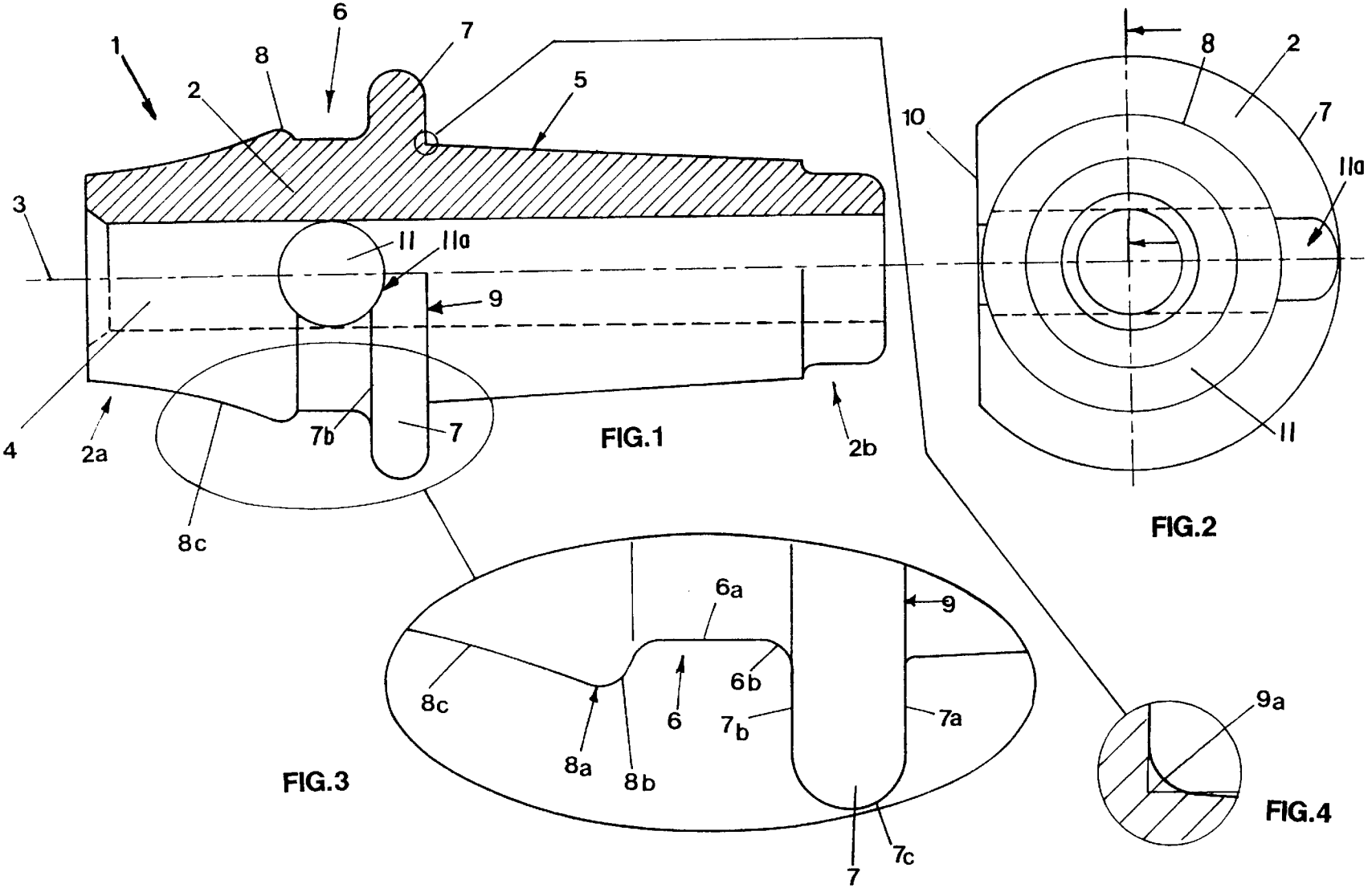
FIG. 1 shows a view of the toolholder of the invention, sectioned according to the longitudinal direction.
FIG. 2 shows the front side view of the toolholder of FIG. 1.
FIG. 3 shows an enlarged detail of the toolholder of FIG. 1.
FIG. 4 shows another enlarged detail of the toolholder of FIG. 1.
Figure 5:
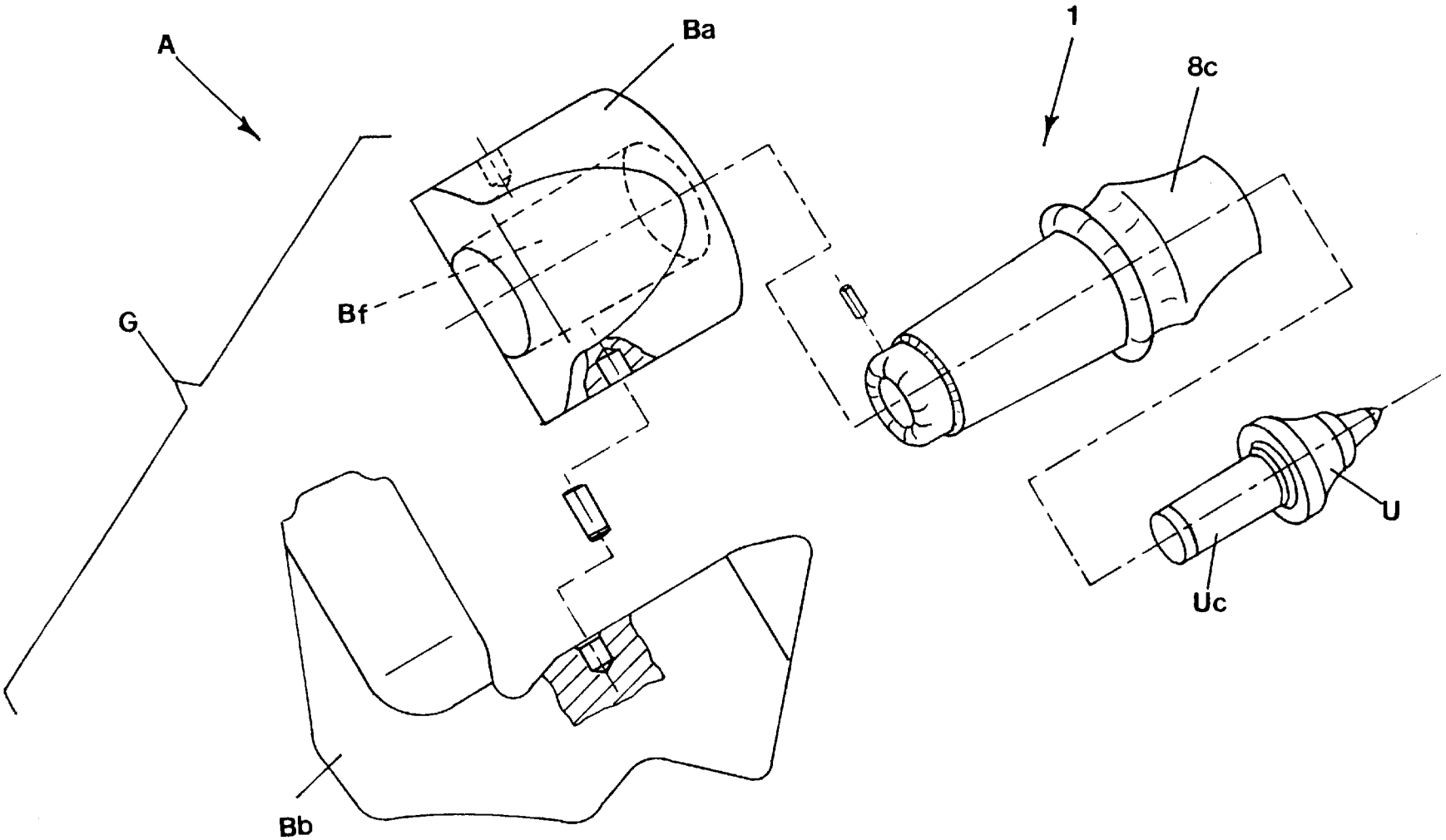
FIG. 5 shows the toolholder of the invention with the removable base and the block welded to the milling drum.

The support unit G, as it can be observed in particular in FIG. 5, includes a removable base Ba provided with a hole Bf housing the toolholder 1 with the tool U applied thereto. The removable base Ba is supported by a base block Bb welded to the external lateral surface D of the milling drum T.

Figure 6:
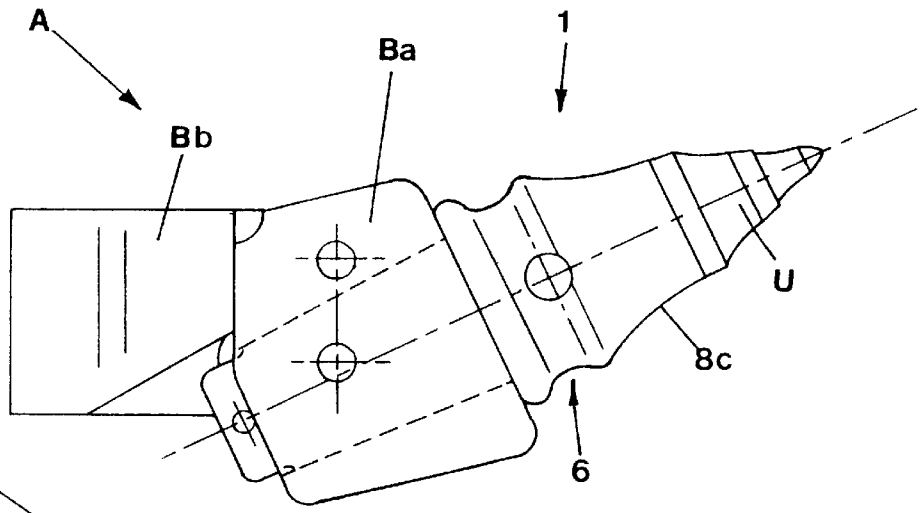
FIG. 6 shows the active element of FIG. 1 once it has been assembled.
Figure 7:
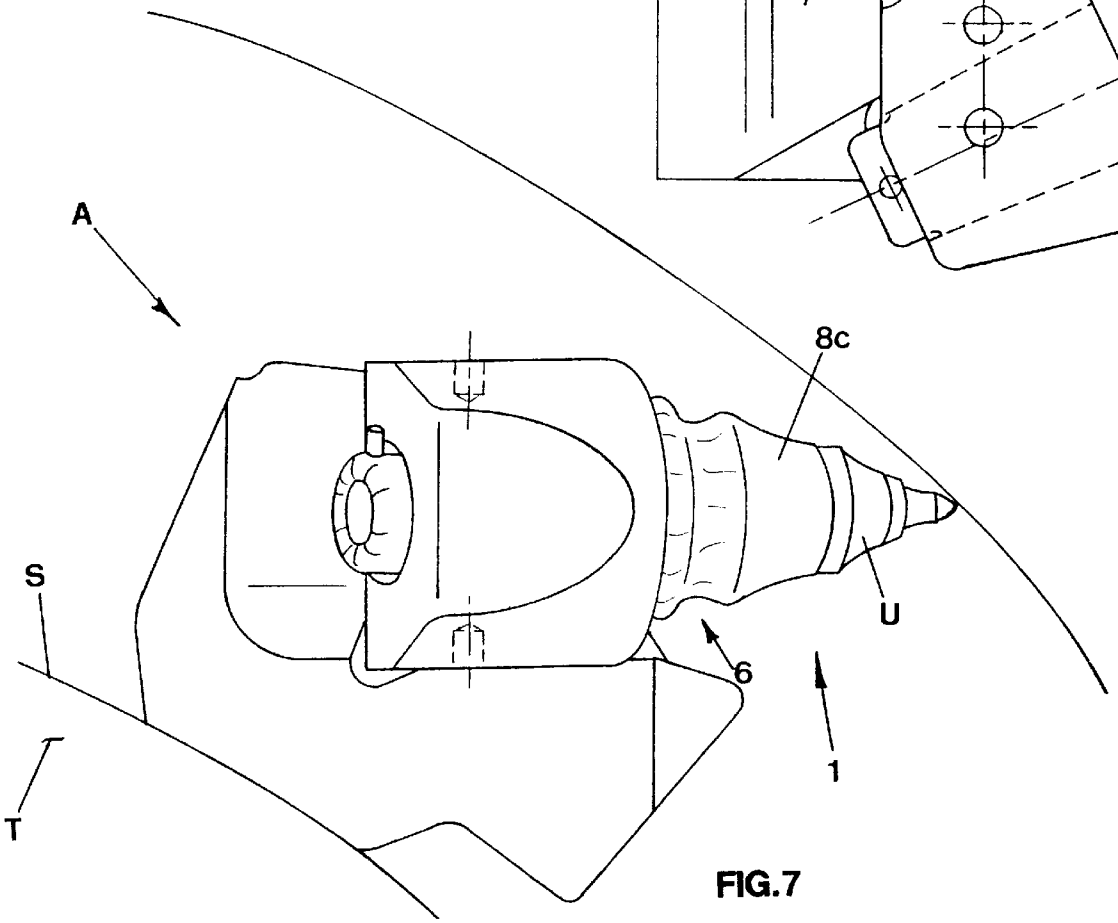
FIG. 7 shows the active element of FIG. 1 applied to the milling drum.

The toolholder 1 and the respective tool U, with the removable base Ba and the base block Bb supporting it, form the active element A of the milling drum T visible in FIGS. 5, 6 and 7.

The toolholder 1, as it can be observed, has a body 2 defining a longitudinal axis and is provided with a longitudinal through hole 4. In correspondence with the first end 2*a*, the through hole 4 removably houses the tang Uc of the tool U.

The lateral external surface of the body 2 of the toolholder 1 has a truncated-cone shaped surface 5 having an inclination converging toward the end 2*b* of the body 2. The opposite end 2*a* of the toolholder 1 housing the tool U. The truncated-cone shaped surface 5 coupled to the corresponding truncated-cone shaped surface through a hole Bf made in the removable base Ba. The truncated-cone shaped surface 5 has a three degrees inclination in order to help the toolholder be extracted from the removable base in which it is housed.

According to the invention, the body 2 of the toolholder 1 has an external annular groove 6 projecting from the supporting unit G that reduces the resisting section of the toolholder 1 in order to define in it a pre-set breaking area.

A hole 11 having a circumference 11*a* is located in the body 2 adjacent the annular collar 7 wherein an extraction tool (not shown) can be inserted for the extraction of tool U.

Therefore, if the active element A (FIGS. 4 to 7) is exposed to greater stresses than the greatest admitted stress, the toolholder 1 will yield in correspondence with the groove 6 avoiding the breaking both of the removable base and of the base block Bb.

It can be observed that the groove 6 is included between an annular collar 7 and an annular projection 8, both projecting radially from the body 2 of the toolholder and both above the larger base 9 of the truncated-cone shaped base C.

The annular collar 7 is defined between a first annular wall 7*a* connected to the larger base 9 of the truncated-cone shaped surface through a first connection 9*a* circularly outlined, and a second annular wall 7*b* connected to the groove 6 through a second connection 6*b* circularly outlined too. In particular, the groove 6 has a bottom surface 6*a* developing circumferentially to the body 2 of the toolholder and therefore has a substantially circular configuration.

The external perimetric surface 7*c* of the annular collar 7 has a curved outline that is convex relative to the outside of the toolholder 1 and is connected to both the annular walls 7*a* and 7*b*.

The presence of the annular collar 7 protects the truncated-cone shaped surface 5 and in particular it prevents foreign bodies from penetrating between the truncated-cone shaped surface 5 and the hole Bf housing it during manufacture.

The annular projection 8 has a curved surface 8*a* that is convex relative to the inside of the toolholder and is connected on one side to the bottom 6*a* of the groove 6 through an inclined wall 8*b* and on the opposite side to the end 2 housing the tool U through a curved surface 8*c* that is concave relative to the outside of the toolholder 1.

The concave outline 8*c* that is concave relative to the outside of the toolholder 1 helps the sliding of the material during the excavation, reducing the abrasive effects on the toolholder. It can be observed in FIG. 2 that in order to prevent the toolholder 1 from rotating around its own longitudinal axis when it is inserted in the respective hole Bf, a plane surface 10 is made outside the toolholder.

That other expedients, such as the toolholder having different shapes and dimensions that those herein described and shown in the drawings can be employed without departing from the spirit of the invention or the scope of the appended claims.

What is claimed is:

1. A toolholder for milling drums of scarifying machines including a body defining a longitudinal axis, at one end provided with a housing for housing a milling tool, said toolholder having a truncated-cone shaped base with a lateral external surface having an inclination converging toward the end opposite to the end housing said tool, said toolholder for removably housing said milling tool in a respective truncated-cone shaped hole in a support unit belonging to an external lateral surface of said milling drum, said body of said toolholder including a plane surface parallel to the longitudinal axis of said toolholder along its length, wherein the body of said tool holder has an external annular groove projecting from said support unit and reducing the resisting section of said toolholder in order to define a pre-set breaking area, said annular groove is included between an annular collar and an annular projection both projecting radially from the body of said toolholder and both formed above a larger base of said truncated-cone shaped base.

2. A toolholder according to claim 1, wherein said annular collar has a first annular wall connected to the larger base of said truncated-cone shaped base and a second annular wall connected to the bottom surface of said groove, said annular walls being located in spaced apart relation and orthogonal to the longitudinal axis of said toolholder.

3. A toolholder according to claim 2, wherein said annular walls are connected to the larger base of said truncated-cone shaped base and to the bottom surface of said groove through circularly outlined connections.

4. A toolholder according to claim 2, wherein said annular collar has an external perimetric surface formed with a curved outline that is convex relative to the outside of said toolholder.

5. A toolholder according to claim 1, wherein said annular projection comprises a curved surface that is concave relative to the inside of said toolholder and is connected at one side to the bottom surface of said groove and on the opposite side to the end of the body of the toolholder housing said milling tool.

6. A toolholder according to claim 5, wherein said end, housing said milling tool, has a truncated-cone shape that is concave relative to the outside of said toolholder.

7. A toolholder according to claim 5, wherein a lateral surface of said end housing said milling tool has, according to a longitudinal section, a curved outline that is concave relative to the outside of said toolholder and is connected to said annular projection.

8. A toolholder according to claim 1, wherein said housing receiving said tool has a through hole formed coaxially in the body of said toolholder, according to the longitudinal axis thereof.

9. A breakaway toolholder for holding a milling tool comprising:

a body defining a longitudinal axis and having a distal end formed with a longitudinal opening for receiving the tool therein;

the body having an external surface in the form of a truncated-cone, said external surface having an annular groove defining a pre-set breaking area;

said annular groove has opposite end portions;

said body has an annular collar and an annular projection projecting radially from the body at the opposite end portions of the annular groove; and a planar surface parallel to the longitudinal axis of the toolholder along its length, is formed in the body.

10. The breakaway toolholder according to claim 9, wherein the groove is formed with a wall portion having a maximum diameter, the toolholder also has a base portion with a diameter greater than the diameter of the groove and said annular collar and annular projection extend outwardly beyond the diameter of the base portion.

11. The breakaway toolholder according to claim 10, wherein said annular collar has a first annular wall connected the base portion and a second annular wall connected to said wall portion of said groove, said annular walls being spaced apart and orthogonal to the longitudinal axis of said toolholder.

12. The breakaway toolholder according to claim 11, including curved wall portions at the ends of the groove and wherein said annular walls are connected to the groove and the base portion.

13. The breakaway toolholder according to claim 11, wherein said annular collar has an external perimetric surface having a curved outline that is convex relative to the outside of said tool holder.

14. The breakaway toolholder according to claim 9, wherein said annular projection having an end portion that is concave relative to the inside of said toolholder.

15. The breakaway toolholder according to claim 14, wherein said distal end for receiving said milling tool is formed with an longitudinal projection having a truncated-cone shape formed with a portion that is concave relative to the outside of said toolholder and is spaced from the distal end.

16. The breakaway toolholder according to claim 9, wherein said opening for receiving said tool extends longitudinally through said body.

17. A breakaway toolholder for holding a milling tool comprising:

a body defining a longitudinal axis, said body having an external surface, a base end and a free end;

a housing at said base end for housing said milling tool;

said base end having a truncated-cone shape with a lateral external surface inclined toward said free end;

a plane surface parallel to said longitudinal axis of said toolholder; and an annular groove defining a pre-set breaking area formed in said external surface of said body and having opposite end portions;

said body has an annular collar and an annular projection projecting radially from the body at the opposite end portions of the annular groove.

* * * * *